US008212647B2

(12) United States Patent
Feuerstein

(10) Patent No.: US 8,212,647 B2
(45) Date of Patent: Jul. 3, 2012

(54) DEVICE HAVING AT LEAST ONE PTC RESISTOR

(75) Inventor: Franz Feuerstein, Simmerberg (DE)

(73) Assignee: Liebherr-Aerospace Lindenberg GmbH, Lindenberg/Allgaeu (DE)

( * ) Notice: Subject to any disclaimer, the term of this patent is extended or adjusted under 35 U.S.C. 154(b) by 808 days.

(21) Appl. No.: 12/288,123

(22) Filed: Oct. 16, 2008

(65) Prior Publication Data

US 2009/0121824 A1 May 14, 2009

(30) Foreign Application Priority Data

Oct. 16, 2007 (DE) ..... 10 2007 049 555

(51) Int. Cl.
*H01C 7/10* (2006.01)

(52) U.S. Cl. ..... 338/22 R; 219/206; 219/505

(58) Field of Classification Search ..... 338/22 R; 219/370, 505, 206

See application file for complete search history.

(56) References Cited

U.S. PATENT DOCUMENTS

| | | | | |
|---|---|---|---|---|
| 3,927,300 | A | 12/1975 | Wada et al. | |
| 4,141,327 | A * | 2/1979 | Marcoux et al. | 123/549 |
| 4,450,823 | A * | 5/1984 | Abe et al. | 123/549 |
| 4,703,153 | A | 10/1987 | Pelonis | |
| 5,471,034 | A | 11/1995 | Kawate et al. | |
| 5,592,647 | A | 1/1997 | Yamauchi et al. | |

FOREIGN PATENT DOCUMENTS

| | | |
|---|---|---|
| DE | 66 04 880 | 3/1970 |
| DE | 2743880 | 4/1979 |
| DE | 37 30 195 | 3/1989 |
| DE | 3820918 | 12/1989 |
| DE | 19933013 | 2/2001 |
| DE | 102 30 066 | 5/2003 |
| DE | 16 26 231 | 2/2006 |
| EP | 0616486 | 9/1994 |
| EP | 1535769 | 6/2005 |

* cited by examiner

*Primary Examiner* — Kyung Lee
(74) *Attorney, Agent, or Firm* — Dilworth & Barrese, LLP.

(57) ABSTRACT

The present invention relates to a device having at least one PCT resistor and having at least one AC voltage source connected to the PTC resistor, with the PTC resistor being dimensioned such that the voltage drop over the PTC resistor does not exceed the value of 40 V/mm.

18 Claims, 2 Drawing Sheets

DEVICE HAVING AT LEAST ONE PTC RESISTOR

BACKGROUND OF THE INVENTION

The present invention relates to a device having at least one PCT resistor.

A PTC resistor is understood as a current conductive material or a component having such a material, with the material being made such that its electrical resistance increases as the temperature rises. Such materials thus have a positive temperature coefficient.

If PTC resistors are operated with AC current, it is possible that they distort the current. Such current distortions, which can represent the harmonic of the fundamental wave, are not wanted for a number of applications or are only permitted to a limited degree. It is in particular of special importance to provide a high-quality on-board voltage in mobile applications such as in aeronautics.

SUMMARY OF THE INVENTION

The object of the present invention therefore consists of reducing the current distortion caused by the PTC resistor to an acceptable degree or to prevent it completely so that a largely or completely non-distorted current evolution or voltage evolution results.

This object is solved by a device having the features herein.

Provision is accordingly made that the PTC resistor is dimensioned such that the voltage drop over the PTC resistor does not exceed the value of 40 V/mm.

The recognition thus underlies the present invention that a PTC resistor produces fewer harmonic vibrations, the lower the applied voltage is. Provision is therefore made in accordance with the invention to limit the applied voltage per dimension (thickness or length) of the PTC resistor, that is, in the direction of the voltage path, to a limit value. It was found in accordance with the invention that this limit value lies at 40 V/mm. The PTC resistor is preferably dimensioned such that the voltage drop over the PTC resistor is no more than 35 V/mm and particularly preferably no more than 30 V/mm per length unit or thickness unit of the PTC resistor. It is possible in this manner, to substantially reduce the proportion of the harmonic, in particular of the 3rd harmonic in the fundamental oscillation.

Within the framework of the present invention, a coherent component or also the composition of a plurality of PTC resistor components is to be understood under the term "PTC resistor". It is thus, for example, conceivable to use a comparatively thick PTC resistor or to connect a plurality of PTC resistors in series, which ultimately has the result that the voltage drop per thickness unit or length unit of the PTC resistor can be reduced to the desired value.

Provided it is possible in the specific application, there is likewise the possibility in accordance with the invention to achieve the indicated limit value in that the applied voltage is reduced with a preset thickness of the PTC resistor.

As stated, an embodiment of the invention consists of the PTC resistor being made up of a plurality of PTC resistor elements connected in series.

In a further aspect of the invention, provision is made that the PTC resistor is made up of a plurality of PTC resistor elements connected in parallel. Such an arrangement can, for example, be necessary when the PTC resistor serves as a heating element and a specific heat-emitting minimum surface should be made available.

It is generally also possible to combine these two embodiments of the invention, that is, to provide a PTC resistor which is made up of PTC resistor elements both connected in series and connected in parallel.

Provision is made in a further embodiment of the invention that the device is a heating device.

The PTC resistor is thus made as a heating element or as a component of a heating device in a preferred embodiment.

The advantage over ohmic resistors consists of the fact that PTC resistors change the electrical resistance in dependence on temperature so that too high a temperature value can be prevented based on the then increased resistance value.

Provision is thus preferably made that the PTC resistor shows a non-linear resistance evolution, i.e. that its resistance increases disproportionately as the temperature rises.

The heating device can comprise a plurality of PTC resistors which are adjoined by one or more heat transfer regions. In this respect, the PTC resistor can be made in the form of one or more plates.

The heat transfer zones preferably have air passages which are, for example, arranged such that the direction of flow through the air passages extends parallel to the plane of the PTC resistors made in plate shape. It is conceivable that the air passages are formed by a lamella-like or rib-like structure which preferably extends in each case at both sides of a PTC resistor.

The heat transfer surfaces are preferably in direct or indirect connection with the PTC resistor(s).

The invention furthermore relates to a heater having one or more devices in accordance with the features herein as well as to a vehicle or aircraft having one or more devices in accordance with the features herein and/or having one or more heaters in accordance with the features herein.

The present invention is in particular of interest for use in aircraft since in this case current distortions of the AC on-board network are particularly unwanted which can be completely or largely prevented by the present invention.

The present invention is, however not restricted thereto, but rather also includes all other areas of use, i.e. stationary applications.

BRIEF DESCRIPTION OF THE DRAWINGS

Further details and advantages of the invention will be explained in more detail with reference to an embodiment shown in the drawing. There are shown.

DESCRIPTION OF THE PREFERRED EMBODIMENTS

Figure 1:
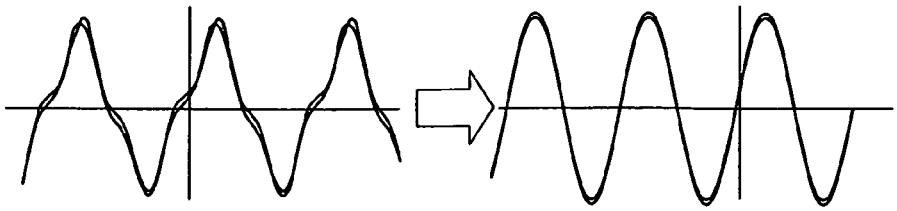
FIG. 1: a schematic representation of the reduction of the power supply in accordance with the present invention.

FIG. 1 shows, in the left hand representation, the current distortion in the AC circuit which is caused by PTC elements and which is reduced to an acceptable degree by the present invention in accordance with FIG. 1, right hand representation.

Figure 2:
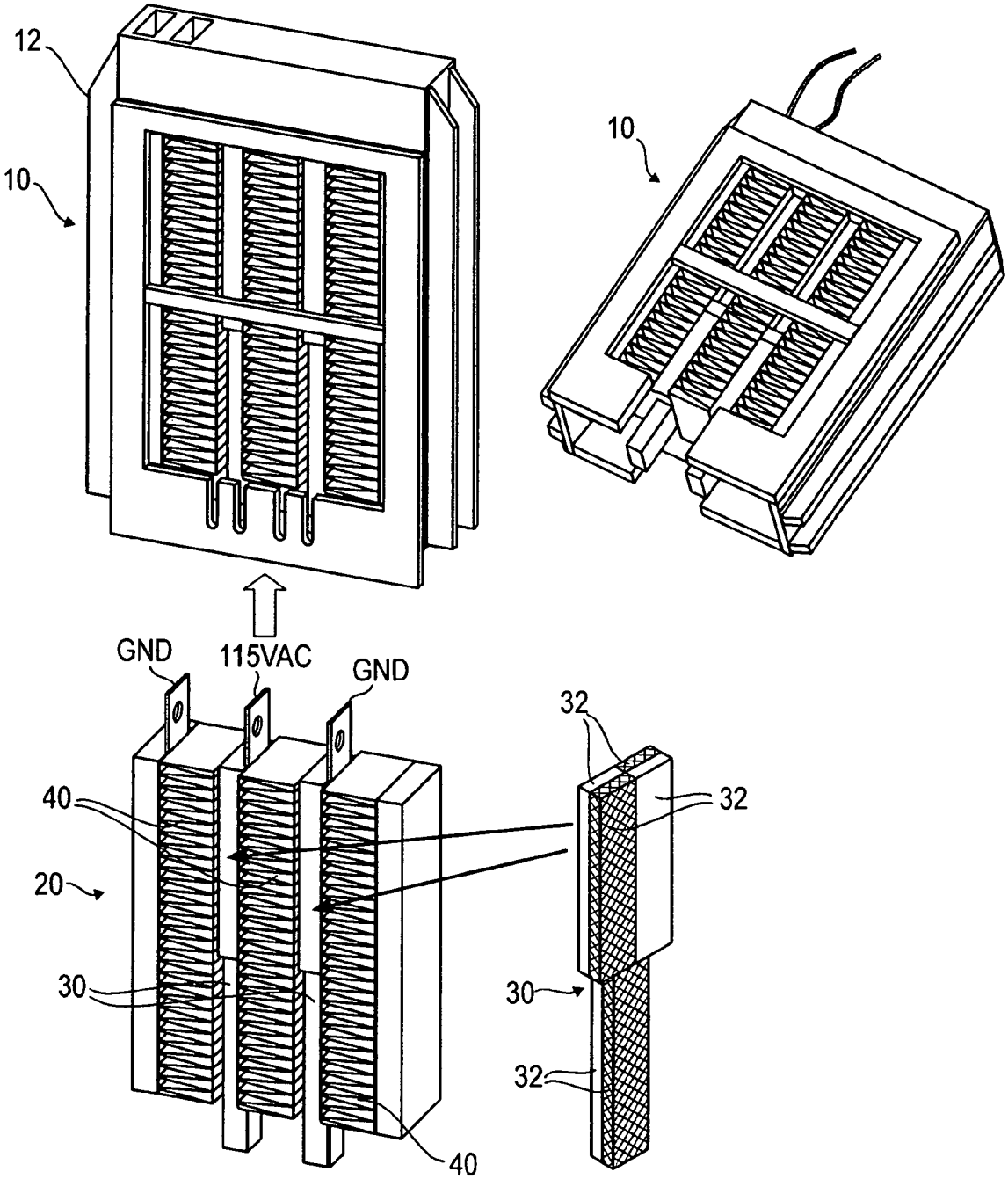
FIG. 2: different views of a heating device with PTC resistors in accordance with the present invention comprising PTC resistor elements.

FIG. 2 shows with the reference numeral 10 a heating device in accordance with the present invention in different embodiments. As can be seen from FIG. 2, the arrangement comprises a housing 12 as well as an insert 20 located therein.

The insert 20 consists of PTC resistors 30 which are each arranged between two heat transfer zones 40. The heat transfer zones 40 have a plurality of adjacent passages arranged above another for air to flow through. As can furthermore be seen from FIG. 2, a respective two of the heat transfer zones 40 adjoin one PTC resistor 30.

The connections and the voltage supply respectively of the heating device 10 are marked by the reference symbols GND and 115 VAC.

As can furthermore be seen from FIG. 2, the PTC resistors in the embodiment shown here consist of six respective PTC resistor elements 32 of which a respective two are connected in series.

Overall, a PTC resistor element 32 consists of two parallel rows disposed on one another having a respective three PTC stones or PTC resistor elements 32. A PTC resistor 30 in accordance with this embodiment thus consists of six PTC resistor elements 32.

The PTC resistor elements 32 can, for example, have a thickness of approximately 2 mm and a width of approximately 6 mm. This is naturally only a feature not restricting the invention.

The PTC resistor elements 32 can be made as ceramic components with a non-linear resistance evolution.

Figure 3:
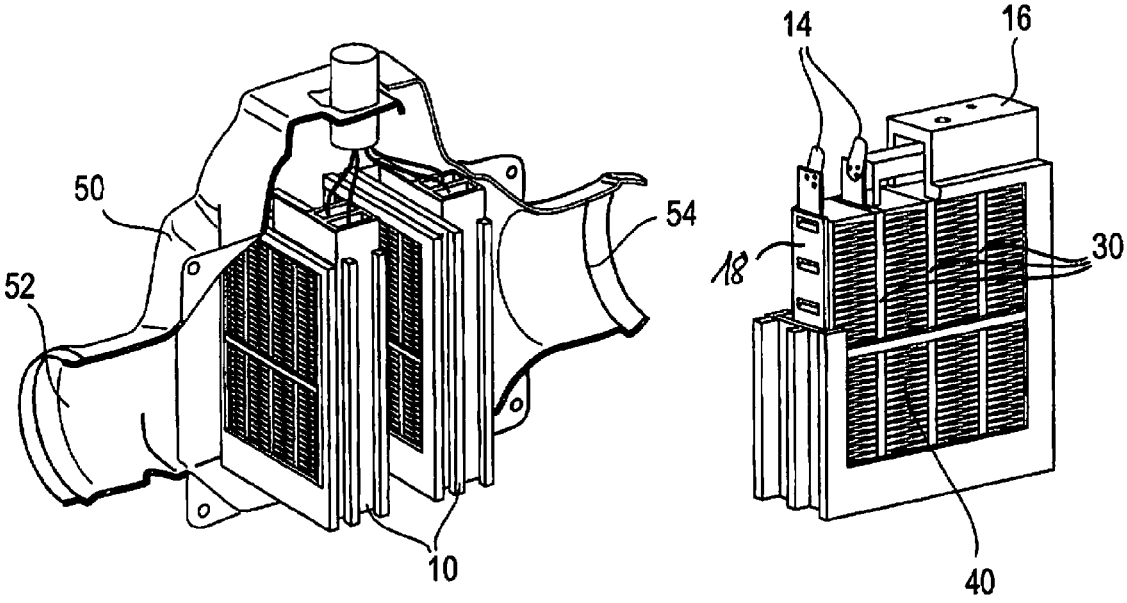
FIG. 3: a schematic representation of a heater with two heating devices arranged therein as well as a heating device in a perspective representation.

FIG. 3 shows a heater 50 having an inlet opening 52 and an outlet opening 54 for the air to be heated or heated.

Two heating devices 10 in accordance with FIG. 3, right hand representation, are arranged transversely to the flow direction of the air. The heating devices 10 are connected in series in the flow direction of the air.

As can be seen from FIG. 3, right hand representation, each of the heating devices 10 comprises a plurality of heat transfer zones 40 as well as PTC resistors 30 respectively arranged between them.

Reference numeral 14 characterizes the electrical connections of the heating element 10 and reference numeral 16 characterizes a housing of the heating element 10 which was manufactured in the injection molding process. The same applies accordingly to the housing of the heater 50. Finally, reference numeral 18 characterizes a spring element for the fixing of the heating element 10.

The heater 50 in accordance with FIG. 3 can be used, for example, to maintain pleasant ambient conditions in the passenger cabin of an aircraft or also in other areas such as the galley or the staff common room, storage spaces, etc. of an aircraft.

The invention claimed is:

1. A device having at least one PTC resistor (30) and having at least one AC voltage source connected to the PTC resistor, wherein the PTC resistor (30) is dimensioned such that the voltage drop over the PTC resistor (30) does not exceed the value of 40 V/mm, the device is a heating device (10), the heating device (10) comprises a plurality of PTC resistors (30) adjoined by one or more heat transfer zones (40), and the heat transfer zones (40) have air passages.

2. A device in accordance with claim 1, wherein the PTC resistor (30) is dimensioned such that the voltage drop over the PTC resistor (30) does not exceed the value of 35 V/mm.

3. A device in accordance with claim 1, wherein the PTC resistor (30) is dimensioned such that the voltage drop over the PTC resistor (30) does not exceed the value of 30 V/mm.

4. A device in accordance with claim 1, wherein the PTC resistor (30) is made up of a plurality of PTC resistor elements (32) connected in series.

5. A device in accordance with claim 1, wherein the PTC resistor (30) is made up of a plurality of PTC resistor elements (32) connected in parallel.

6. A device in accordance with claim 1, the PTC resistor (30) is made up of PTC resistor elements (32) both connected in series and connected in parallel.

7. A device in accordance with claim 1, wherein the PTC resistors (30) are made in plate shape.

8. A device in accordance with claim 7, wherein the air passages are arranged such that the flow direction through the air passages extends parallel to the plane of the PTC resistors (30) made in plate shape.

9. A device in accordance with claim 1, wherein the PTC resistor is a ceramic PTC resistor.

10. A heater (50) having one or more devices in accordance with claim 1.

11. A vehicle or aircraft having one or more devices and/or heaters (50) in accordance with claim 10.

12. A device in accordance with claim 2, wherein the PTC resistor (30) is dimensioned such that the voltage drop over the PTC resistor (30) does not exceed the value of 30 V/mm.

13. A device in accordance with claim 12, wherein the PTC resistor (30) is made up of a plurality of PTC resistor elements (32) connected in series.

14. A device in accordance with claim 2, wherein the PTC resistor (30) is made up of a plurality of PTC resistor elements (32) connected in series.

15. A device in accordance with claim 3, wherein the PTC resistor (30) is made up of a plurality of PTC resistor elements (32) connected in series.

16. A device in accordance with claim 15, wherein the PTC resistor (30) is made up of a plurality of PTC resistor elements (32) connected in parallel.

17. A device in accordance with claim 14, wherein the PTC resistor (30) is made up of a plurality of PTC resistor elements (32) connected in parallel.

18. A device in accordance with claim 13, wherein the PTC resistor (30) is made up of a plurality of PTC resistor elements (32) connected in parallel.

* * * * *